US006913874B2

(12) United States Patent
Haller et al.

(10) Patent No.: US 6,913,874 B2
(45) Date of Patent: Jul. 5, 2005

(54) HIGHLY LUBRICATED IMAGING ELEMENT WITH ELASTOMERIC MATTE

(75) Inventors: Christopher J. Haller, Rochester, NY (US); Charles C. Anderson, Penfield, NY (US); Eugene A. Armour, Rochester, NY (US); William J. Hennessey, Rochester, NY (US); Peter D. Rollinson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 25 days.

(21) Appl. No.: 10/689,881

(22) Filed: Oct. 21, 2003

(65) Prior Publication Data

US 2005/0084810 A1 Apr. 21, 2005

(51) Int. Cl.[7] ..... G03C 1/765; G03C 1/85; G03C 1/95; G03C 1/76

(52) U.S. Cl. ..... 430/496; 430/527; 430/531; 430/950; 430/961

(58) Field of Search ..... 430/496, 527, 430/531, 950, 961

(56) References Cited

U.S. PATENT DOCUMENTS

| | | | | |
|---|---|---|---|---|
| 2,322,037 | A | 6/1943 | Lindquist | |
| 2,992,101 | A | 7/1961 | Jelley et al. | |
| 3,767,448 | A | 10/1973 | Hutton | |
| 4,094,848 | A | 6/1978 | Naito | |
| 4,142,894 | A | 3/1979 | Hori et al. | |
| 4,447,525 | A | 5/1984 | Vallarino et al. | |
| 4,524,131 | A | 6/1985 | Himmelmann et al. | |
| 4,822,727 | A | 4/1989 | Ishigaki et al. | |
| 5,679,505 | A | 10/1997 | Tingler et al. | |
| 5,786,298 | A | 7/1998 | Tsou et al. | |
| 5,800,973 | A | 9/1998 | Anderson et al. | |
| 5,916,741 | A | 6/1999 | Smith et al. | |
| 5,965,304 | A | 10/1999 | Yau et al. | |
| 6,033,839 | A | 3/2000 | Smith et al. | |
| 6,303,281 | B1 | 10/2001 | Wang et al. | |
| 6,326,131 | B1 * | 12/2001 | Schell et al. | 430/505 |

FOREIGN PATENT DOCUMENTS

| | | |
|---|---|---|
| EP | 1 113 317 | 7/2001 |

OTHER PUBLICATIONS

Research Disclosure, Item 38957, pp. 615–616, Sep., 1996.

* cited by examiner

*Primary Examiner*—Richard L. Schilling
(74) *Attorney, Agent, or Firm*—Andrew J. Anderson

(57) ABSTRACT

A photographic imaging element is disclosed comprising a support having on a front side thereof a silver halide imaging layer and an outermost protective overcoat layer comprising a film-forming binder, and on the backside thereof an outermost protective backcoat layer comprising a film-forming binder; the protective overcoat and backcoat layers each comprising a lubricant present in an amount of at least 5 mg/m$^2$ and permanent matting agent having a $T_g$ of at least 40° C. and an average particle size of from about 0.5 to about 3 micrometers in an amount of at least 1 mg/m$^2$; and at least one of the protective overcoat layer or the protective backcoat layer further comprising crosslinked elastomeric polymer matte particles, wherein the crosslinked elastomeric polymer matte particles have a $T_g$ of 20° C. or less, an average particle size of at least 90% of or greater than that of the permanent matting agent particles having a $T_g$ of at least 40° C. in the protective layer in which the crosslinked elastomeric matte is included, and are present in the protective overcoat layer or protective backcoat layer in an amount which is (i) at least 1 mg/m$^2$ and (ii) less than the total level of permanent matting agent particles having a $T_g$ of at least 40° C. in the protective overcoat and backcoat layers combined. Imaging elements comprising highly lubricated protective outermost layers in accordance with the invention advantageously provide increased scratch and wear resistance, while the presence of relatively low $T_g$ crosslinked elastomeric matte particles in combination with higher $T_g$ permanent matte particles has been found to increase the coefficient of friction of the layer in which they are included to provide good manufacturability of the imaging element while also maintaining wear and other desired film performance properties.

20 Claims, No Drawings

HIGHLY LUBRICATED IMAGING ELEMENT WITH ELASTOMERIC MATTE

FIELD OF THE INVENTION

The present invention relates to imaging elements, and more particularly in a specific embodiment to a motion picture print film photographic elements.

BACKGROUND OF THE INVENTION

Prior generations of many motion picture photographic film elements that are used as print films for movie theater projection have long used a carbon black-containing layer on the backside of the film. This backside layer provides both antihalation protection and antistatic properties prior to film processing, as well as reasonable friction (necessary for both roller conveyance and also in the film roll handling/winding process) even when the emulsion coating protective layer had elevated levels of lubricant (for scratch/abrasion protection). The carbon black is applied in an alkali-soluble binder that allows the layer to be removed by a process that involves soaking the film in alkali solution, scrubbing the backside layer, and rinsing with water, leaving bare support on the non-emulsion side of the film. The bare support has excellent wear and scratch properties, and the emulsion side can be protected by the elevated levels of lubricant surviving the processing. This carbon black removal process, however, which takes place prior to image development, is both tedious and environmentally undesirable since large quantities of water are utilized in this film processing step. In addition, in order to facilitate removal during film processing, the carbon black-containing layer is not highly adherent to the photographic film support and may dislodge during various film manufacturing operations such as film slitting and film perforating. Carbon black debris generated during these operations may become lodged on the photographic emulsion and cause image defects during subsequent exposure and film processing.

After removal of the carbon black-containing layer, antistatic properties provided thereby are lost. Undesired static charge build-up can then occur on processed motion picture print film when transported through projectors or on rewind equipment. While discharge of high static charges does not cause static marks on the processed photographic film as the film's light sensitive silver halide has also been removed during film processing, high static charges can attract dirt particles to the film surface. Once on the film surface, these dirt particles can create abrasion or scratches or, if sufficiently large, the dirt particles may be seen on the projected film image.

U.S. Pat. No. 5,679,505 describes a motion picture print film which, in place of a carbon black-containing layer on the backside of the film, contains an antihalation undercoat on the front side of the film support under the film emulsion layers, and an antistatic layer and a protective topcoat on the backside of the support. The backing layer protective topcoat is comprised of a polyurethane binder and lubricant. The polyurethane binder has a tensile elongation to break of at least 50% and a Young's modulus measured at 2% elongation of at least 50000 lb/in$^2$. Despite the toughness of this overcoat, abrasive wear and the subsequent dust generation have continued to be a problem with backing layer protective topcoats in motion picture print film. During the lifetime of a print in a theater, abrasions in the perforation area can become severe enough that the soundtrack is damaged. In addition, dust can build up in the picture area of the film and reduce the quality of the projected image.

One approach that greatly reduces projector dust is to heavily lubricate the backside protective overcoat. However, at the lubricant levels necessary to reduce dusting in projectors, the coefficient of friction of the overcoat is reduced to the point that such a film is non-manufacturable because support rolls have insufficient traction for satisfactory conveyance in high speed sensitizing machines, and also because the long, slit rolls of photographic film become telescoped or dished in storage or shipping, wherein the roll integrity is at risk.

U.S. Pat. No. 6,326,131 discloses one solution to the problem of providing both high lubrication as well as desired friction. In such disclosure, an additive is included in the lubricant containing backside protective overcoat layer, where the additive is selected to be immiscible with and more surface active than the lubricant, and is added in an amount effective to increase the coefficient of friction for the overcoat layer. Tetraethylammoniun salt of perfluorooctyl sulfonic acid (Fluorotenside FT-248 by Bayer, A.G.), e.g., is disclosed as a specific example of an effective additive which maybe added to a highly lubricated backside protective overcoat to raise the coefficient of friction of such overcoat. This, along with limiting lubricant levels in the imaging side protective overcoat layer, can result in adequate conveyance and winding performance. There have recently been efforts to minimize the use of perfluorooctyl sulfonate (PFOS) based surfactants, however, and accordingly it would be desirable to find alternatives to use of such material as a friction improving additive in highly lubricated layers.

The incorporation of matting agents in the outermost layers of photographic elements is well known. These matting agents can reduce the potential for a photographic film to ferrotype when the backside of the film is in contact with the front side (i.e., emulsion side) of the film under the pressures that are typical of, for example, a tightly wound roll of film. Ferrotyping may cause the two sides of the film to stick together, and, under severe cases of ferrotyping, damage to the emulsion side surface layer may occur when the roll is unwound. In some cases, ferrotyping may have an adverse effect on the sensitometric response of the photographic emulsion. Matting agents are also employed for such purposes as reduction of static charging and excessive sheen, pencil mark acceptance and avoidance of Newton's rings. A wide variety of materials have been employed as matting agents including both inorganic and polymeric fine particles as illustrated by *Research Disclosure*, Item 38957, pages 615–616, September 1996.

Large quantities of matting agents are often employed for the purposes described above. However, the use of a large quantity of matting agent may result in undesirable side effects such as increased haze and graininess of the processed image. To overcome these limitations, a matting agent that is removed during film processing is often employed in place of "permanent" matting agents. Such "removable" or "soluble" matting agents are typically alkali soluble polymeric matte particles comprising, for example, a copolymer of methyl methacrylate and methacrylic acid. Soluble matte particles are described, for example, in U.S. Pat. Nos. 2,322,037; 2,992,101; 3,767,448; 4,094,848; 4,142,894; 4,447,525 and 4,524,131. Because these matte particles are removed during film processing, they can generally be employed in the photographic film at relatively high dried coating weights, for example, 200 mg/m$^2$ or more of matte particles, without excessively impacting haze. However, in some cases the use of large quantities of even soluble matting agent may result in undesirable side effects.

Soluble matte beads have a tendency to swell or dissolve during preparation, delivery, or coating of the solution containing the matte beads thus causing various types of coating defects in the film. During film processing, the removal of soluble matte beads may leave behind pits or craters in the coating, these may be visible especially under the very high magnifications typically used for viewing a motion picture print film, for example. Further, the use of large quantities of soluble matting agent (as well as permanent matting agent) may generate a fine dust of particles due to the matting agent being dislodged from the unexposed and unprocessed film during film manufacture and use. As with carbon black and other dirt particle debris, the matte dust generated may become lodged on the photographic emulsion and cause image defects during subsequent exposure and film processing. In addition, these dislodged particles may scratch and abrade the photographic film.

Any matting agent (permanent or soluble) used in motion picture print films can also potentially affect image quality and soundtrack reproduction during theater viewing. Large amounts of permanent or soluble matting agent present in a print film emulsion overcoat during printing of the print film from a duplicate negative will result in image graininess during projection. Even moderate amounts of permanent matting agent present on either side of the exposed and processed print film can affect image graininess during projection. Soundtrack reproduction quality (i.e., frequency response and signal-to-noise ratio) may be degraded at substantially lower matting agent levels than those necessary to affect image quality, this is especially true for those films that utilize a digital soundtrack. U.S. Pat. No. 5,679,505 referenced above, e.g., describes photographic element especially useful as a motion picture print film comprised of a support having on one side an antihalation undercoat and at least one silver halide emulsion layer and having on the opposite side an antistatic layer and a protective backing layer topcoat comprised of a polyurethane binder. The backing layer topcoat includes from 1 to 100 mg/m$^2$, preferably from 15 to 65 mg/m$^2$, of matte beads. Examples in the '505 patent teach a backing layer topcoat having 30.7 mg/m$^2$ permanent matte and an emulsion overcoat having 5 mg/m$^2$ permanent matte.

Relatively low Tg crosslinked elastomeric matting agent particles have also been disclosed for use in photographic elements. U.S. Pat. No. 5,786,298, e.g., discloses the use of crosslinked elastomeric matte beads having a $T_g$ of 10° C. or less in a backing layer to reduce scratches and abrasions which may be formed in the imaging side of the element. U.S. Pat. No. 5,800,973 discloses the use of crosslinked elastomeric matte beads in combination with hard filler particles in an imaging element backing layer. U.S. Pat. No. 5,916,741 discloses the use of crosslinked elastomeric matte particles in photographic element layers to reduce pressure sensitivity and dusting characteristics in transport and finishing operations. The prior art has not suggested, however, the use of a relatively lower amount of low Tg crosslinked elastomeric matte particles in combination with conventional high Tg matte in a highly lubricated photographic element.

It would be desirable to provide photographic film elements with highly lubricated protective layers on both the backside and the image layer side in order to provide increased wear protection in addition to adequate conveyance and winding performance.

SUMMARY OF THE INVENTION

In accordance with one embodiment of the invention, a photographic imaging element is disclosed comprising a support having on a front side thereof a silver halide imaging layer and an outermost protective overcoat layer comprising a film-forming binder, and on the backside thereof an outermost protective backcoat layer comprising a film-forming binder;

the protective overcoat and backcoat layers each comprising a lubricant present in an amount of at least 5 mg/m$^2$ and permanent matting agent having a $T_g$ of at least 40° C. and an average particle size of from about 0.5 to about 3 micrometers in an amount of at least 1 mg/m$^2$; and at least one of the protective overcoat layer or the protective backcoat layer further comprising crosslinked elastomeric polymer matte particles, wherein the crosslinked elastomeric polymer matte particles have a $T_g$ of 20° C. or less, an average particle size of at least 90% of or greater than that of the permanent matting agent particles having a $T_g$ of at least 40° C. in the protective layer in which the crosslinked elastomeric matte is included, and are present in the protective overcoat layer or protective backcoat layer in an amount which is (i) at least 1 mg/m$^2$ and (ii) less than the total level of permanent matting agent particles having a $T_g$ of at least 40° C. in the protective overcoat and backcoat layers combined.

In accordance with a particularly preferred embodiment of the present invention there is provided a color motion picture print film element comprising a support having on a front side thereof, in order, an antihalation undercoat, a yellow dye image-forming unit comprising at least one blue-sensitive silver halide emulsion layer having associated therewith at least one yellow dye-forming coupler, a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and an outermost protective overcoat layer, and on the backside thereof an antistatic layer and an outermost protective backcoat layer, wherein the outermost protective overcoat and backcoat layers comprise lubricant and matte particles as described above.

Imaging elements comprising highly lubricated protective outermost layers in accordance with the invention advantageously provide increased scratch and wear resistance, while the presence of relatively low $T_g$ crosslinked elastomeric matte particles in combination with higher $T_g$ permanent matte particles has been found to increase the coefficient of friction of the layer in which they are included to provide good manufacturability of the imaging element while also maintaining wear and other desired film performance properties.

DETAILED DESCRIPTION OF THE INVENTION

Photographic elements of the invention comprise a support having on one side thereof at least one silver halide emulsion layer and an outermost protective overcoat layer, and having on the opposite side thereof an outermost protective backcoat layer. In preferred embodiments, the elements of the invention may include an antihalation undercoat between the support and the silver halide emulsion layer, and an antistatic layer on either side of the support, more preferably between the support and the protective backcoat layer.

The outermost protective overcoat and the outermost protective backcoat layers of the elements of the invention comprise film-forming binder, lubricant, and matting agent. The use of film-forming hydrophilic colloids as binders in photographic elements, including photographic films and photographic papers, is well known. The most commonly used of these is gelatin and gelatin is a particularly preferred material for use in the outermost protective-overcoat layer of this invention. It can preferably be used as the binder in the protective overcoat, antihalation undercoat and in the silver halide emulsion layer(s). Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The film-forming binder useful in the protective backcoat of the invention can be essentially any known polymeric binder. This includes the abovementioned hydrophilic colloids as well as hydrophobic polymers. Useful hydrophobic polymers include polyurethanes, polyesters, polymides, polycarbonates, cellulose esters, acrylic polymers, styrenic polymers, and the like. Particularly preferred polymeric binders for use in the backcoat of the invention include polyurethanes such as those described in U.S. Pat. No. 5,679,505 which is incorporated herein by reference. Preferably, the polyurethane is an aliphatic polyurethane. Aliphatic polyurethanes are preferred due to their excellent thermal and UV stability and freedom from yellowing. Preferred polyurethanes are characterized as those having a tensile elongation to break of at least 50% and a Young's modulus measured at an elongation of 2% of at least 50,000 $lb/in^2$. These physical property requirements insure that the outermost protective backcoat layer is hard yet tough to simultaneously provide excellent abrasion resistance and outstanding resiliency to allow the protective layer to survive hundreds of cycles through apparatus such as a motion picture projector. The polyurethane protective layer is preferably coated from a coating formula containing from about 0.5 to about 10.0 weight percent of polyurethane to give a dry coverage of from about 50 to about 3000 $mg/m^2$. The dry coverage of the protective layer is more preferably from about 300 to 2000 $mg/m^2$.

The polyurethane may be either organic solvent soluble or aqueous dispersible. For environmental reasons, aqueous dispersible polyurethanes are preferred. Preparation of aqueous polyurethane dispersions is well-known in the art and involves chain extending an aqueous dispersion of a prepolymer containing terminal isocyanate groups by reaction with a diamine or diol. The prepolymer is prepared by reacting a polyester, polyether, polycarbonate, or polyacrylate having terminal hydroxyl groups with excess polyfunctional isocyanate. This product is then treated with a compound that has functional groups that are reactive with an isocyanate, for example, hydroxyl groups, and a group that is capable of forming an anion, typically this is a carboxylic acid group. The anionic groups are then neutralized with a tertiary amine to form the aqueous prepolymer dispersion. The chemical resistance of the polyurethane protective layer can be improved by adding a crosslinking agent that reacts with functional groups present in the polyurethane, for example, carboxyl groups. Crosslinking agents such as aziridines, carbodiimides, epoxies, and the like are suitable for this purpose. The crosslinking agent can be used at about 0.5 to about 30 weight percent based on the polyurethane. However, a crosslinking agent concentration of about 2 to 12 weight percent based on the polyurethane is preferred.

Imaging elements in accordance with the invention comprise outermost protective overcoat and backcoat layers, each of which comprise a relatively high level of a lubricant, i.e. dry coverage of at least 5 $mg/m^2$, preferably at least 10 $mg/m^2$, and more preferably from 10 to 50 $mg/m^2$. Such high levels of lubricants provides improved wear performance in movie projectors and other apparatus through which imaging elements may be conveyed, by reducing abrasions and dust generation. High lubricant levels in the protective overcoat of at least 20 $mg/m^2$, or even at least 30 $mg/m^2$, may be useful to provide improved wear performance of the emulsion layer side of the photographic element. Lubricant levels of above even 50 $mg/m^2$ may be employed, but typically will provide little additional wear protection. Useful lubricants include silicones, perfluorinated polymer particles, natural and synthetic waxes, stearates, amides, higher alcohol esters of fatty acids, higher fatty acid calcium salts, paraffins and the like as described in, e.g., U.S. Pat. Nos. 2,588,756, 3,121,060, 3,295,979, 3,042,522 and 3,489,567. Aqueous dispersed lubricants are strongly preferred, since lubricants in this form can be incorporated directly into an aqueous coated protective layer formula, thus avoiding the need for a separately applied lubricant overcoat on the protective topcoat layer. The aqueous dispersed lubricants of carnauba wax, polyethylene oxide, microcrystalline wax, paraffin wax, stearates and amides work well as lubricants in aqueous coated protective topcoats.

In practice of the present invention the protective overcoat and the backcoat each comprise at least 1 $mg/m^2$ of permanent matting agent having a $T_g$ of at least 40° C. and an average size of from about 0.5 to about 3 micrometers, preferably of from about 0.75 to about 2.5 micrometers. Preferably, the total amount of relatively high $T_g$ permanent matte in the overcoat and backcoat layers combined is from about 10 to 50 $mg/m^2$, more preferably from about 15 to 40 $mg/m^2$. The requirement that the protective overcoat and backcoat each comprise at least 1 $mg/m^2$ of relatively high $T_g$ permanent matte, and that the total is preferably at least 10 $mg/m^2$, provides good transport characteristics throughout the entire manufacturing process and use of the film. The high Tg permanent matting agent may be silica or other mineral oxides, calcium carbonate, glass spheres, ground polymers, or polymeric matte beads. Polymeric matte beads are preferred because of their uniformity of shape and uniformity of size distribution. The high $T_g$ polymeric matte beads may be crosslinked or uncrosslinked. The surface of the matte beads may be attached to gelatin or other hydrophilic colloids to improve their dispersibility in aqueous media. The polymeric matte beads may be prepared by a limited coalescence process such as described in U.S. Pat. Nos. 4,965,131 and 5,133,912, which are incorporated herein by reference.

For satisfactory film transport characteristics, the most preferred range for imaging element backing layer surface coefficient of friction is from about 0.15 to 0.3. At the high lubricant coverages desired to provide scratch and abrasion resistance in accordance with the invention, the coefficient of friction for the imaging element surface may drop to about 0.10 or even lower. If the protective backcoat coefficient of friction is significantly below 0.15, and the protective overcoat is also highly lubricated, there is a danger that long, slit rolls of the photographic film may become unstable in storage or shipping and become telescoped or dished, a condition common to unstable film rolls. If the backcoat layer coefficient of friction is above 0.30 at manufacture or becomes greater than 0.30 after photographic film processing, a common condition of non-process surviving protective overcoat lubricants, the photographic film transport characteristics become poorer, particularly in some types of photographic film printers and projectors.

The inventors have surprisingly found that the incorporation of a relatively low level (relative to total amount of relatively high Tg permanent matting agent in the protective overcoat and backcoat layers combined) of crosslinked elastomeric matte beads into at least one of the outermost protective layers can substantially improve wound roll integrity while maintaining the improved wear properties provided by the high levels of lubricant. At least one protective outermost layer of photographic element in accordance with the invention accordingly comprises at least 1 mg/m$^2$ of crosslinked elastomeric matting agent having a $T_g$ of 20° C. or less, preferably 10° C. or less, wherein the crosslinked elastomeric matte is of an average particle diameter of at least 90% of or greater than that of the relatively high $T_g$ permanent matte in the protective outermost layer. Where the crosslinked elastomeric matte is included in the protective backcoat, in addition to improving wound roll integrity, the crosslinked elastomeric matte also raises the coefficient of friction of the backcoat layer, improving transport characteristics of the film during manufacturing and use. Where the crosslinked elastomeric matte is included in the protective overcoat, it is particularly helpful in improving wound roll integrity when employing very high levels of lubricant in the overcoat layer.

The use of elastomeric matte of a particle size of at least close to (i.e., at least 90%) or greater than that of the high $T_g$ permanent matte enables the use of relatively low levels of such matte to be effective. While the relatively low $T_g$, crosslinked elastomeric matte is preferably of a size at least slightly greater than that of the relatively high $T_g$ permanent matte, such crosslinked elastomeric matte is still preferably within the preferred size range of from about 0.5 to about 3 micrometers, more preferably from about 0.75 to about 2.5 micrometers.

In contrast to conventional matte beads which are harder and have a higher $T_g$, crosslinked elastomeric matte beads employed in the invention have a lower $T_g$ and are resilient. In a particularly preferred embodiment, the crosslinked elastomeric beads used in the invention may be made from an interpolymer of ethylenically unsaturated monomers such as acrylic or methacrylic acid and their esters such as butyl-, ethyl-, propyl-, hexyl-, 2-ethyl hexyl-, 2-chloroethyl-, 4-chlorobutyl- or 2-ethoxyethyl-acrylate or methacrylate, hydroxyethyl acrylate or hydroxyethyl methacrylate, styrene and its derivatives, butadienes, ethylene, propylene, vinyl chloride, vinylidene chloride, itaconic acid and its esters, and the like, wherein the monomers are selected to provide the desired relatively low Tg. The elastomeric beads may be crosslinked with various crosslinking agents, which may also be part of the elastomeric interpolymer, such as divinylbenzene, ethylene glycol diacrylate, ethylene glycol dimethacrylate, 1,4-cyclohexylene-bis(oxyethyl) dimethacrylate, 1,4-cyclohexylene-bis(oxypropyl) diacrylate, 1,4-cyclohexylene-bis(oxypropyl) dimethacrylate, etc.

It is preferred that the elastomeric beads contain greater than 2 percent by weight of a crosslinking agent, most preferably from 3 to 40 percent by weight of a crosslinking agent, as the degree of matte bead elasticity is determined by the amount of crosslinking agent employed in making the matte bead. If the amount of crosslinking agent used is too high, the matte beads produced will be too rigid. If the amount of crosslinking agent in the matte beads is too low, the matte beads will not only be deformed under pressure, but will also undergo nonelastic flow leading to permanent deformation, making recovery of their original shape impossible. Thus, the crosslinked elastomeric matte beads used in the invention preferably have a combination of both the proper $T_g$ and the preferred level of crosslinking in order to achieve a desired degree of elasticity.

The crosslinked elastomeric matte beads may contain reactive functional groups capable of forming covalent bonds with the binder polymer by intermolecular crosslinking or by reaction with a crosslinking agent in order to improve adhesion of the matte beads to the coated layers. Suitable reactive functional groups include: hydroxyl, carboxyl, carbodiimide, epoxide, aziridine, vinyl sulfone, sulfinic acid, active methylene, amino, amide, allyl, and the like.

The crosslinked elastomeric beads may also comprise polycondensation products such as polyurethanes, polysiloxanes, polyesters, and polyethers. The beads may also be prepared from natural and synthetic rubbers such as those described in "Rubber Technology", Werner Hofmann, Hansen Publishers, New York, 1989. Such rubber materials include polyisoprene, fluoroelastomers, epichlorohydrin rubbers, polypropylene oxide rubbers, chlorinated polyethylene rubber, natural rubber, and the like.

In a preferred embodiment, each of the protective overcoat and the protective backcoat comprise at least 1 mg/m$^2$ of elastic matting agent having a $T_g$ of less than 20° C. or less. In order to prevent undesirably too high friction, however, the total amount of crosslinked elastomeric matting agent in the overcoat and backcoat combined is preferably less than 25 mg/m$^2$, more preferably less than 20 mg/m$^2$, and most preferably less than 15 mg/m$^2$. In order to insure low haze which provides improved soundtrack reproduction, the total amount of relatively high $T_g$ permanent matte in combination with the amount of crosslinked elastomeric matte in the overcoat and backcoat layers combined is preferably less than 50 mg/m$^2$, more preferably less than 40 mg/m$^2$.

Use of low levels of permanent matting may be facilitated by use of soluble matting agent, which is removed upon photographic processing, in combination with the high $T_g$ permanent matte and the low $T_g$ crosslinked elastomeric matte employed in accordance with the invention. At least one of the overcoat or backcoat layers of the photographic elements of the invention accordingly may additionally comprise soluble matting agent. Soluble matting agent may be any particulate material which is insoluble in water and soluble in aqueous alkali media Particularly preferred soluble matting agents, e.g., are polymeric matte beads that are copolymers of an alkyl methacrylate and methacrylic acid such as those described in U.S. Pat. Nos. 2,992,101; 3,767,448; 4,142,894 and 4,447,525. Soluble matting agent, when employed, is preferably of the same average dimensions as the permanent matte (i.e., an average size of from about 0.5 to about 3 micrometers). When employing a total of less than 40 mg/m$^2$ of permanent matte, e.g., a combined amount of soluble matte in the overcoat and backcoat layers that is from 2.5 to 30 mg/m$^2$, in particular, can enable improved ferrotyping protection for the unprocessed film while avoiding problems associated with the use of larger quantities of soluble matte. The total high $T_g$ permanent, low $T_g$ crosslinked elastomeric, and soluble matting agent amount in the overcoat and backcoat layers combined is preferably less than 70 mg/m$^2$, more preferably less than 50 mg/m$^2$.

In addition to film-forming binder, lubricant, and matting agents the protective overcoat and the protective backcoat of the invention may optionally contain surface active agents, antistatic agents, charge control agents, thickeners, ultraviolet light absorbers, processing removable dyes, high boiling point solvents, colloidal inorganic particles, magnetic recording particles, polymer latexes, and crosslinking agents (i.e., hardeners).

The materials employed as the support member are synthetic high molecular weight polymeric materials. These materials may be comprised of various polymeric films, but polyester and cellulose triacetate film supports, which are well known in the art, are preferred. The thickness of the support is not critical. Conventional support member thicknesses of from about 50 to 250 microns (2 to 10 mils, or 0.002 to 0.010 inches) can be employed, for example, with very satisfactory results. Polyester support members typically employ a primer layer between the functional layers and the polyester support. Such primer layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088; 2,698,235; 2,698,240; 2,943,937; 3,143,421; 3,201,249; 3,271,178 and 3,501,301.

The antihalation undercoat used in preferred embodiments of this invention functions to prevent light from being reflected into the silver halide emulsion layer(s) and thereby causing an undesired spreading of the image which is known as halation. Any of the filter dyes known to the photographic art can be used in the present invention as a means of reducing halation. Thus, for example, water-soluble dyes can be used for this purpose. Such dyes should be incorporated in the antihalation undercoat with a mordant to prevent dye diffusion. Alternatively, and preferably, a solid particle filter dye is incorporated in the antihalation undercoat.

Useful water-soluble filter dyes for the purpose of this invention include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonol dyes of U.S. Pat. Nos. 3,486,897; 3,652,284 and 3,718,472, the enamino hemioxonol dyes of U.S. Pat. No. 3,976,661, the cyanomethyl sulfone-derived merocyanines of U.S. Pat. No. 3,723,154, the thiazolidones, benzotriazoles, and thiazolothiazoles of U.S. Pat. Nos. 2,739,888; 3,253,921; 3,250,617 and 2,739,971, the triazoles of U.S. Pat. No. 3,004,896, and the hemioxonols of U.S. Pat. Nos. 3,125,597 and 4,045,229. Useful mordants are described, for example, in U.S. Pat. Nos. 3,282,699; 3,455,693; 3,438,779 and 3,795,519.

Preferred examples of solid particle filter dyes for use in antihalation undercoat layers include those which are substantially insoluble at aqueous coating pH's of less than 7, and readily soluble or decolorizable in aqueous photographic processing solutions at pH of 8 or above, so as to be removed from or decolorized in a photographic element upon photographic processing. By substantially insoluble is meant dyes having a solubility of less than 1% by weight, preferably less than 0.1% by weight. Such dyes are generally of the formula:

$$D\text{-}(X)_n$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton preferably has a pKa (acid dissociation constant) value measured in a mixed solvent of water and ethanol at 1:1 volume ratio within the range of 4 to 11, and may be, e.g., a carboxyl group, a sulfonamido group, a sulfamoyl group, a sulfonylcarbamoyl group, a carbonylsulfamoyl group, a hydroxy group, and the enol group of a oxanol dye or ammonium salts thereof. The filter dye should have a log P hydrophobicity parameter of from 0–6 in its non-ionized state. Such general class of ionizable filter dyes is well known in the photographic art, and includes, e.g., dyes disclosed for use in the form of aqueous solid particle dye dispersions as described in International Patent Publication WO 88/04794, European patent applications EP 594 973; EP 549 089; EP 546 163 and EP 430 180; U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179 and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

Preferred dyes of the above formula include those of formula:

$$[D\text{-}(A)_y]\text{-}X_n$$

where D, X and n are as defined above, and A is an aromatic ring bonded directly or indirectly to D, y is 0 to 4, and X is bonded either on A or an aromatic ring portion of D.

Exemplary dyes of the above formulas include those in Tables I to X of WO 88/04794, formulas (I) to (VII) of EP 0 456 163 A2, formula (II) of EP 0 594 973, and Tables I to XVI of U.S. Pat. No. 4,940,654 incorporated by reference above. Preferred examples of solid particle filter dyes include the following:

D-1

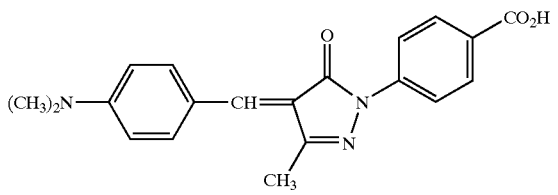

D-2

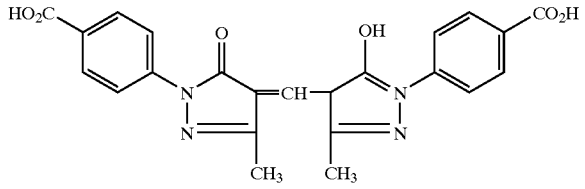

-continued

D-3

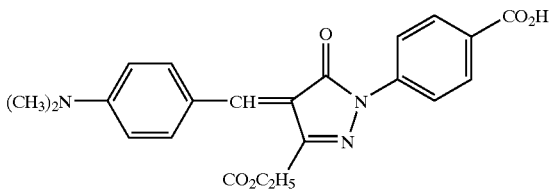

D-4

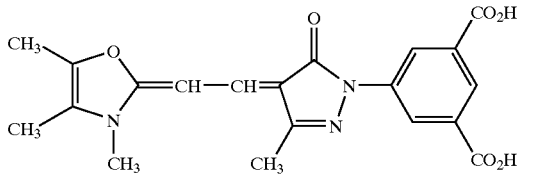

D-5

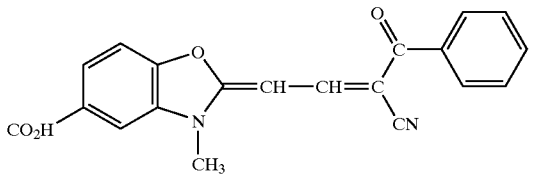

D-6

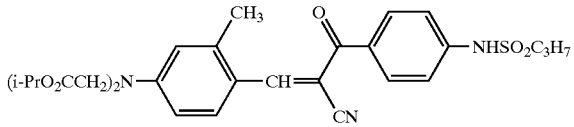

D-7

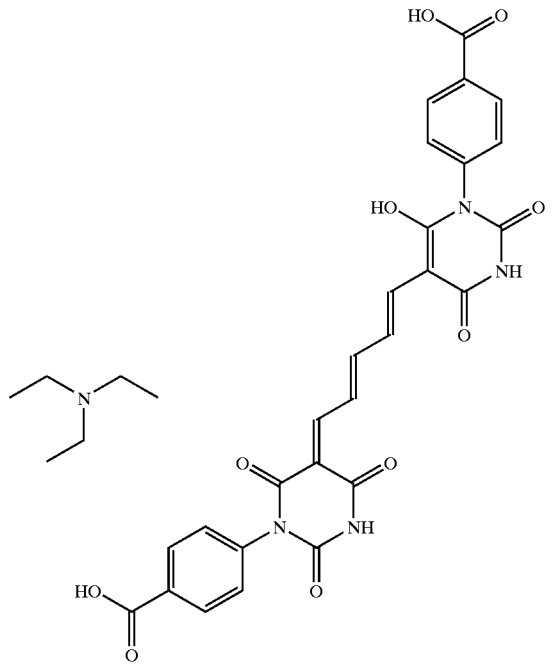

To promote adhesion of the antihalation undercoat to the support, primer layers as hereinabove described are advantageously employed, especially when the support is a polyester support.

The photographic elements of the present invention can be simple black-and-white or monochrome elements or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A typical multicolor photographic print element in accordance with preferred embodiments of the invention comprises a support bearing, in order, a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler. Each of the cyan, magenta, and yellow image forming units may be comprised of a single light-sensitive layer, a pack of two light-sensitive layers with one being more light sensitive and the other being less light-sensitive, or a pack of three or more light-sensitive layers of varying light-sensitivity.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. Photographic print films, however, typically use relatively small grain, high chloride silver halide emulsions (e.g., emulsions having average grain size equivalent circular diameters of less than about 1 micron and halide contents of greater than 50 mole % chloride) in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that motion picture color print films, e.g., when rated using the same international standards criteria used for rating camera negative films, would typically have an ISO speed rating of less than 10, which is several stops slower than the slowest camera negative films in current use. The emulsions typically will be gelatin emulsions although other hydrophilic colloids can be used in accordance with usual practice. The compositions of typical light sensitive image recording layers used in print films are well known, and are not critical to the invention, as any of the silver halide materials used in conventional motion picture films may be used, such as those described, e.g., in *Research Disclosure*, Item 36544, September, 1994, and the references listed therein.

The photographic silver halide emulsions utilized in this invention can contain other addenda conventional in the photographic art. Useful addenda are described, for example, in *Research Disclosure*, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

In addition to an antihalation undercoat, protective overcoat and backcoat and one or more emulsion layers, the motion picture films of the present invention can contain auxiliary layers conventional in photographic elements, such as primer layers, subbing layers, spacer layers, filter layers, interlayers, pH lowering layers (sometimes referred to as acid layers and neutralizing layers), magnetic recording layers, timing layers, barrier layers and antistatic layers.

In a particularly preferred embodiment the motion picture films of the invention include an antistatic layer whose antistatic properties survive film processing. The antistatic layer may be present on either side or both sides of the support material. The antistatic layer may be an internal layer that underlies the antihalation undercoat, protective overcoat, protective backcoat or the one or more emulsion layers. Alternatively, the antistatic layer may be an outermost layer in which the electrically conductive material is included in the protective overcoat or protective backcoat.

Antistatic layers useful in elements of this invention may include a variety of electrically conductive metal-containing particles, such as metal oxides, dispersed in a binder material. Examples of useful electrically conductive metal-containing particles include donor-doped metal oxides, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103; 4,394,441; 4,416,963; 4,418,141; 4,431,764; 4,495,276; 4,571,361; 4,999,276; 5,122,445 and 5,368,995. Other useful electrically conductive materials for use in antistatic layers of this invention include: Semiconductive metal salts such as cuprous iodide as described in U.S. Pat. Nos. 3,245,833; 3,428,451 and 5,075,171; Fibrous conductive powders comprising, for example, antimony-doped tin oxide coated onto non-conductive potassium titanate whiskers as described in U.S. Pat. Nos. 4,845,369 and 5,116,666; A colloidal gel of vanadium pentoxide or silver-doped vanadium pentoxide as described in U.S. Pat. Nos. 4,203,769, 5,006,451, 5,221,598 and 5,284,714; Conductive polymers, such as, the cross-linked vinylbenzyl quaternary ammonium polymers of U.S. Pat. No. 4,070,189, the conductive polyanilines of U.S. Pat. No. 4,237,194, and conductive polythiophenes 0f U.S. Pat. Nos. 4,987,042, 5,035,926, 5,354,613, 5,370,981, 5,372,924, 5,543,944 and 5,766,515.

A polymer binder, such as a vinylidene-chloride-containing terpolymer latex or a polyesterionomer dispersion, is preferably employed in the antistatic layer to improve the integrity of the layer and to improve adhesion to an undercoat layer. The antistatic coating formulation may also contain a coating aid to improve coatability. Typically, the antistatic layer is coated at a dry coverage of from 1 to 1000 mg/m$^2$ based on total dry weight. The electrical resistivity of the antistatic layer is typically preferably from about 7 to about 11 log Ω/□, more preferably from about 8 to 11 log Ω/□, and most preferably from about 8.5 to 10 log Ω/□.

In a particularly preferred embodiment, photographic elements of the invention may comprise an antistatic layer coated on the backside of the support from a coating composition comprising a polythiophene/polyanion composition containing polythiophene with conjugated polymer backbone component and a polymeric polyanion component, and a protective outermost backcoat layer comprised of a polyurethane binder which has a tensile elongation to break of at least 50% and a Young's modulus measured at 2% elongation of at least 50000 lb/in$^2$; wherein the electrical resistivity of the electrically-conductive layer before photographic processing is less than $2\times10^9$ Ω/□, after photographic processing is between $1\times10^9$ Ω/□ and $1\times10^{11}$ Ω/□, and increases by at least one order of magnitude as a result of photographic processing. Such combinations of antistatic layer and protective outermost backcoat are the subject of U.S. Pat. No. 6,440,654, the disclosure of which is incorporated by reference herein. Photographic imaging elements comprising such combination of layers effectively minimize both raw (pre-photographic processing) static marking and processed (after photographic processing) photographic element sticking caused by the accumulation of electrostatic charges, and additionally have excellent resistance to scratch and abrasion, which may be further improved with highly lubricated outermost layers in accordance with the present invention.

The following examples are intended to illustrate the present invention but not to limit it in scope in any way.

EXAMPLE 1

Comparison print film Element A was prepared as follows:

A subbed polyester support was prepared by first applying a subbing layer comprising a vinylidene chloride copolymer to both sides of a support before drafting and tentering so that the final dried coating weight of the subbing layer was about 90 mg/m$^2$.

An electrically-conductive layer was applied onto one side of the support, comprising an electrically-conductive agent and a film forming binder. The electrically-conductive agent used in the coating was Baytron P™ (poly(3,4-ethylene dioxythiophene)/poly(styrene sulfonate), available from Bayer Corporation), which was supplied in the form of an aqueous dispersion comprising 0.5 wt % poly(3,4-ethylene dioxythiophene) ("PEDOT") and 0.8 wt % poly (styrene sulfonate) ("PSS"). The film forming binder used was Eastman Chemical AQ29D polyesterionomer. The PEDOT/PSS was coated at a coverage of 2.4 mg/m$^2$, and the AQ29D binder was coated at a coverage of 21 mg/m$^2$.

A protective outermost backcoat layer having the following general composition was applied onto the electrically-conductive layer.

| | |
|---|---|
| Sancure 898 (B. F. Goodrich Corp.) polyurethane binder, modulus = 115,000 lb/in$^2$, elongation to break = 210% | 970 mg/m$^2$ |
| Neocryl CX-100 (Zeneca Resins) polyfunctional aziridine crosslinker | 50 mg/m$^2$ |
| Permanent Polymer matte (polymethylmethacrylate beads, avg. size = 1.5 $\mu$m) | 27 mg/m$^2$ |
| Michemlube 160 (Michelman, Inc.) carnauba wax | 16 mg/m$^2$ |
| Charge control fluorosurfactant (FT-248, Bayer) | 14 mg/m$^2$ |
| Coating Aid Surfactant (Triton TX-100, Rohm and Haas) | 11 mg/m$^2$ |

A conventional gelatin subbing layer was applied onto the vinylidene chloride copolymer subbing layer on the side of the support opposite to the electrically-conductive layer and outermost protective backcoat. Then, an antihalation undercoat having the following composition was applied onto the gelatin subbing layer:

| | |
|---|---|
| Gelatin | 700 mg/m$^2$ |
| Solid particle dye D-1 | 53 mg/m$^2$ |
| Solid particle dye D-7 | 120 mg/m$^2$ |
| Coating surfactant | 14 mg/m$^2$ |
| $H_2SO_4$ | 5 mg/m$^2$ |
| Poly(acrylamide-co-2-acrylamido-2-methylpropane sodium sulfonate) | 23 mg/m$^2$ |
| Gelatin Hardener | 150 mg/m$^2$ |

The antihalation undercoat was then overcoated with silver halide emulsion layers suitable for color motion picture print film (a yellow dye image-forming unit comprising a blue-sensitive silver chloride emulsion layer having associated therewith a yellow dye-forming coupler, a cyan dye image-forming unit comprised of a red-sensitive silver chloride emulsion layer having associated therewith a cyan dye-forming coupler, and a magenta dye image-forming unit comprising a green-sensitive silver chloride emulsion layer having associated therewith a magenta dye-forming coupler), and a protective overcoat having the following composition was applied over the emulsion layers:

| | |
|---|---|
| Deionized gelatin | 907 mg/m$^2$ |
| Polydimethylsiloxane lubricant (Dow Corning) | 16 mg/m$^2$ |
| Permanent Polymer matte (polymethylmethacrylate beads, avg. size = 1.5 $\mu$m) | 15 mg/m$^2$ |
| $H_2SO_4$ | 2 mg/m$^2$ |
| Charge control fluorosurfactant (FT-248, Bayer) | 5 mg/m$^2$ |
| Coating surfactant (Triton TX-200E, Rohm and Haas) | 27 mg/m$^2$ |

Comparison print film Element B was prepared similarly as Element A, except that a combination of 3.5 mg/m$^2$ of Zonyl FSN (Dupont) (partially fluorinated non-ionic ethoxylated surfactant) and 11 mg/m$^2$ of Aerosol OT (Cytec Industries, Inc.) (sodium dioctyl sulfosuccinate) was used in place of the FT-248 fluorosurfactant in the backcoat protective layer, and 6 mg/m$^2$ of tetra ethyl ammonium hydroxide neutralized Zonyl FS-62 (Dupont) (partially fluorinated ionic surfactant) was used in place of the FT-248 fluorosurfactant in the emulsion side overcoat protective layer.

Print film Element C in accordance with one embodiment of the invention was prepared similarly as Element B, except that a combination of 12 mg/m$^2$ of the relatively high $T_g$ PMMA permanent matte beads (avg. size=1.5 $\mu$m) and 13 mg/m$^2$ of crosslinked elastomeric matte particles (poly (butyl acrylate-co-ethyleneglycol dimethacrylate), 86/14 mole ratio, $T_g$=−37° C., avg. size=2.0 $\mu$m) was used in place of the 27 mg/m$^2$ of PMMA matte in the backcoat protective layer.

Print film Element D in accordance with another embodiment of the invention was prepared similarly as Element C, except that a combination of 10 mg/m$^2$ of the relatively high $T_g$ PMMA permanent matte beads (avg. size=1.5 $\mu$m) and 6 mg/m$^2$ of crosslinked elastomeric matte particles (poly (butyl acrylate-co-ethyleneglycol dimethacrylate), avg. size=2.0 $\mu$m, same as used in the backcoat protective layer of Element C) was used in place of the 16 mg/m$^2$ of PMMA matte in the emulsion side overcoat protective layer, the lubricant in the overcoat was increased to 32 mg/m$^2$, and additional lubricant (16 mg/m$^2$ Teflon PTFE 30 (Dupont) fluoropolymer resin and 32 mg/m$^2$ Michem Tuff 200 wax (Michelman, Inc.) was added to the backcoat protective layer.

Print film Element E in accordance with another embodiment of the invention was prepared similarly as Element B, except that a combination of 3 mg/m$^2$ of the relatively high $T_g$ PMMA permanent matte beads (avg. size=1.5 $\mu$m) and 13 mg/m$^2$ of crosslinked elastomeric matte particles (poly (butyl acrylate-co-ethyleneglycol dimethacrylate), avg, size=2.0 $\mu$m, same as used in the backcoat protective layer of Element C) was used in place of the 16 mg/m$^2$ of PMMA matte in the emulsion side overcoat protective layer.

Comparison print film Element F was prepared similarly as Element B, except that level of polydimethylsiloxane lubricant employed in the emulsion side overcoat protective layer was increased 16 mg/m$^2$ to 49 mg/m$^2$.

Elements A–F thus comprised protective emulsion side overcoats and protective backcoats with relatively high $T_g$ permanent matte, relatively low $T_g$ elastomeric matte, and lubricant coating levels as indicated in Table 1. Elements B–F additionally differed from Element A in that Element A employed PFOS fluorosurfactant FT-248, while Elements B–F employed alternative partially fluorinated surfactants.

TABLE 1

| | Backcoat | | | Overcoat | | |
|---|---|---|---|---|---|---|
| Sample | High $T_g$ Permanent matte, mg/m$^2$ | Low $T_g$ Elastomeric matte, mg/m$^2$ | Lubricant level mg/m$^2$ | High $T_g$ Permanent matte, mg/m$^2$ | Low $T_g$ Elastomeric matte, mg/m$^2$ | Lubricant level mg/m$^2$ |
| Element A (Comp.) | 27 | — | 16 | 16 | — | 16 |
| Element B (Comp.) | 27 | — | 16 | 16 | — | 16 |
| Element C (Inv.) | 12 | 13 | 16 | 16 | — | 16 |
| Element D (Inv.) | 12 | 13 | 65 | 10 | 6 | 32 |
| Element E (Inv.) | 27 | — | 16 | 3 | 13 | 16 |
| Element F (Comp.) | 27 | — | 16 | 16 | — | 49 |

The film elements prepared as described above were tested for conveyance, wound roll integrity and wear properties, both before and after conventional motion picture color print film standard ECP-2B photographic processing. Conveyance performance (pre-processing) was ascertained by measuring the backing coefficient of friction when the backside was slid against a hardcoated aluminum roller with 1 pli tension, using ASTM G 143 test procedure. Good conveyance results are expected if the coefficient of friction is within a range of about 0.15 to 0.25. The lower limit minimizes the risk of scratches and cinches. The upper limit minimizes the risk of creases and excessive weave. Wound roll integrity is measured (pre-processing) using a narrow web telescope force measurement. A force is applied to various parts of a 600 M. (3.5 cm wide) length roll of film and the force to initialize telescoping is measured. The minimum telescope force at 7.62 cm diameter is desirably at least 890 Newtons for 600 M (3.5 cm wide) length rolls. Wear measurements were done using a Microtribometer wear test using a 4.0-millimeter diameter steel ball, a force of 400-grams and a speed of 100 revolutions per minute. The diameter of the ball wear track was 25.4 millimeters. Each coating was tested once on both the emulsion and backsides of the raw and processed samples. The coefficients of friction were recorded for each test and the criterion for failure was a significant change in friction traces over time and reported as sliding distance to failure. The Microtribometer measurement would be indicative to wear in printers, processors, cameras and projectors. Higher values in this test indicate higher expected durability of the coating and hence less wear, abrasion and dirt in the typical trade usage. This would lead to reduced imperfections to the end use customer such as spots, scratches and other defects. The following Table 2 list the results of these tests:

TABLE 2

| Sample | COF (Back to Roller, 1 PLI) | Tele-scoping Force (N) | Sliding Distance (Meters) to Failure - Raw (Imaging/Back) | Sliding Distance (Meters) to Failure - Processed (Imaging/Back) |
|---|---|---|---|---|
| Element A (Comp.) | 0.17 | 1245 | 0.8/32.1 | 1.0/65 |
| Element B (Comp.) | 0.14 | 800 | 0.9/64.6 | 0.5/174 |
| Element C (Inv.) | 0.24 | 925 | 0.6/51.1 | 0.8/84.5 |
| Element D (Inv.) | 0.26 | 890 | 4.9/121.3 | 5.8/159 |
| Element E (Inv.) | 0.14 | 1112 | 1.1/84.8 | 1.8/309 |
| Element F (Comp.) | 0.13 | 845 | 9.3/34.5 | 9.0/124.4 |

The results presented in Table 2 show that Elements C, D and E employing a combination of relatively high $T_g$ permanent matte and relatively low $T_g$ elastomeric matte in either the protective backcoat or protective overcoat layers provide improvements with respect to obtaining desired backside COF for transport characteristics or increased telescoping force. Element D employing such combination of matte particles in each of the emulsion side overcoat and the backcoat in accordance with a preferred embodiment of the invention provides improved performance in both such measurements.

EXAMPLE 2

A comparison print film Element G was prepared with photographic emulsion layers similarly as for Element A, and with protective overcoat and backcoat layers as described for Element A.

Print film Element H in accordance with one embodiment of the invention was prepared similarly as Element G, except that outermost backcoat and overcoat layers had the following general compositions:

| | |
|---|---|
| Backcoat: | |
| Sancure 898 (B. F. Goodrich Corp.) polyurethane binder, modulus = 115,000 lb/in$^2$, elongation to break = 210% | 970 mg/m$^2$ |
| Neocryl CX-100 (Zeneca Resins) polyfunctional aziridine crosslinker | 50 mg/m$^2$ |
| Permanent Polymer matte (polymethylmethacrylate beads, avg. size = 1.5 $\mu$m) | 25 mg/m$^2$ |
| Crosslinked elastomeric matte (poly(butyl acrylate-co-ethyleneglycol dimethacrylate), 86/14 mole ratio, Tg = −37° C., avg. size = 2.0 $\mu$m) | 2.1 mg/m$^2$ |
| Michemlube 160 carnauba wax (Michelman, Inc.) | 16 mg/m$^2$ |
| Charge control surfactant (Zonyl FSN (Dupont) partially fluorinated surfactant) | 14 mg/m$^2$ |
| Additional Surfactant (Aerosol OT) | 11 mg/m$^2$ |
| Coating Aid Surfactant (Triton TX-100) | 11 mg/m$^2$ |
| Overcoat: | |
| Deionized gelatin | 876 mg/m$^2$ |
| Polydimethylsiloxane lubricant (Dow Corning) | 48 mg/m$^2$ |
| Permanent Polymer matte (polymethylmethacrylate beads, avg. size = 1.5 $\mu$m) | 4 mg/m$^2$ |
| Crosslinked elastomeric matte (poly(butyl acrylate-co-ethyleneglycol dimethacrylate), 86/14 mole ratio, Tg = −37° C., avg. size = 2.0 $\mu$m) | 4 mg/m$^2$ |
| $H_2SO_4$ | 2 mg/m$^2$ |
| Charge control surfactant (Zonyl FS-62 (Dupont) partially fluorinated surfactant) | 6 mg/m$^2$ |
| Coating surfactant (Triton TX-200E) | 21 mg/m$^2$ |

Elements G and H were evaluated as in Example 1, and Table 3 lists the results of these tests:

TABLE 3

| Sample | COF (Back to Roller - 1 PLI) | Tele-scoping Force (N) | Sliding Distance (Meters) to Failure - Raw (Imaging/Back) | Sliding Distance (Meters) to Failure - Processed (Imaging/Back) |
|---|---|---|---|---|
| Element G (Comp.) | 0.17 | 1503 | 2.5/14.5 | 3.3/44.0 |
| Element H (Inv.) | 0.15 | 1388 | 9.7/16.9 | 29.7/70.0 |

The results presented in Table 4 show that Element H in accordance with a preferred embodiment of the invention employing a combination of relatively high $T_g$ permanent matte and relatively low $T_g$ elastomeric matte enables the use of exceptionally high levels of lubricant in the overcoat protective layer (desirable for wear performance as demonstrated in comparison Element F in Example 1), while also maintaining desired friction (conveyance) and telescoping force (wound roll integrity) performance (features not obtained in comparison Element F). Such results are obtained even in the absence of PFOS fluorosurfactant FT-248 as employed in comparison Element G.

While the invention has been described in detail with particular reference to preferred embodiments, it will be understood that variations and modifications can be effected within the spirit and scope of the invention.

What is claimed is:

1. A photographic imaging element comprising a support having on a front side thereof a silver halide imaging layer and an outermost protective overcoat layer comprising a film-forming binder, and on the backside thereof an outermost protective backcoat layer comprising a film-forming binder;

the protective overcoat and backcoat layers each comprising a lubricant present in an amount of at least 5 mg/m$^2$ and permanent matting agent having a $T_g$ of at least 40° C. and an average particle size of from about 0.5 to about 3 micrometers in an amount of at least 1 mg/m$^2$; and at least one of the protective overcoat layer or the protective backcoat layer further comprising crosslinked elastomeric polymer matte particles, wherein the crosslinked elastomeric polymer matte particles have a $T_g$ of 20° C. or less, an average particle size of at least 90% of or greater than that of the permanent matting agent particles having a $T_g$ of at least 40° C. in the protective layer in which the crosslinked elastomeric matte is included, and are present in the protective overcoat layer or protective backcoat layer in an amount which is (i) at least 1 mg/m$^2$ and (ii) less than the total level of permanent matting agent particles having a $T_g$ of at least 40° C. in the protective overcoat and backcoat layers combined.

2. An element according to claim 1, wherein lubricant is present in the protective overcoat layer in an amount of at least 10 mg/m$^2$.

3. An element according to claim 1, wherein lubricant is present in the protective overcoat layer in an amount of at least 20 mg/m$^2$.

4. An element according to claim 1, wherein lubricant is present in the protective overcoat layer in an amount of at least 30 mg/m$^2$.

5. An element according to claim 1, wherein at least the protective overcoat layer comprises the crosslinked elastomeric polymer matte particles in an amount which is at least 1 mg/m$^2$.

6. An element according to claim 1, wherein at least the protective backcoat layer comprises the crosslinked elastomeric polymer matte particles in an amount which is at least 1 mg/m$^2$.

7. An element according to claim 1, wherein each of the protective overcoat layer and the protective backcoat layer comprise the crosslinked elastomeric polymer matte particles in an amount which is at least 1 mg/m$^2$.

8. An element according to claim 7, wherein the total amount of crosslinked elastomeric matte particles in the overcoat and backcoat combined is from 2 to 25 mg/m$^2$.

9. An element according to claim 7, wherein the total amount of crosslinked elastomeric matte particles in the overcoat and backcoat combined is from 2 to 20 mg/m$^2$.

10. An element according to claim 7, wherein the total amount of crosslinked elastomeric matte particles in the overcoat and backcoat combined is from 2 to 15 mg/m$^2$.

11. An element according to claim 1, wherein the crosslinked elastomeric polymer matte particles have a $T_g$ of 10° C. or less.

12. An element according to claim 1, wherein the crosslinked elastomeric polymer matte particles have an average particle size greater than that of the permanent matting agent particles having a $T_g$ of at least 40° C. in the protective layer in which the crosslinked elastomeric matte is included.

13. An element according to claim 1, wherein the crosslinked elastomeric polymer matte particles have an average particle size of from about 0.5 to about 3 micrometers.

14. An element according to claim 1, further comprising an antistatic layer on either side of the support.

15. An element according to claim 14, wherein the antistatic layer is coated between the support and the outermost backcoat layer.

16. An element according to claim 15, wherein the film forming binder for the outermost backcoat comprises an aliphatic polyurethane.

17. An element according to claim 16, wherein the outermost protective backcoat layer comprises a polyurethane binder which has a tensile elongation to break of at least 50% and a Young's modulus measured at a 2% elongation of at least 50000 lb/in$^2$.

18. An element according to claim 1, wherein the element comprises a multicolor motion picture photographic print film element having on one side of the support, in order, an antihalation undercoat, a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and the outermost protective overcoat layer comprising a film-forming binder, and on the backside thereof an antistatic layer and the outermost protective backcoat layer comprising a film-forming binder.

19. An element according to claim 18, wherein each of the protective overcoat layer and the protective backcoat layer comprise the crosslinked elastomeric polymer matte particles in an amount which is at least 1 mg/m$^2$.

20. An element according to claim 19, wherein the total amount of crosslinked elastomeric matte particles in the overcoat and backcoat combined is from 2 to 25 mg/m$^2$.

* * * * *